United States Patent [19]

Gilbert

[11] 4,179,061

[45] Dec. 18, 1979

[54] PARTITIONED CONTAINER

[75] Inventor: Earl F. Gilbert, Farmington Hills, Mich.

[73] Assignee: Westvaco Corporation, New York, N.Y.

[21] Appl. No.: 948,818

[22] Filed: Oct. 5, 1978

[51] Int. Cl.[2] ..... B65D 5/42; B65D 5/48

[52] U.S. Cl. ..... 229/27; 229/41 B

[58] Field of Search ..... 229/28, 27, 41 B, 41 R

[56] References Cited

U.S. PATENT DOCUMENTS

| | | | |
|---|---|---|---|
| 2,743,863 | 5/1956 | Glaser | 229/27 |
| 2,829,778 | 4/1958 | Carabet | 229/27 X |
| 2,998,179 | 8/1961 | Zilles | 229/27 |
| 3,049,279 | 8/1962 | Mairs et al. | 229/27 |
| 3,123,276 | 3/1964 | Mairs | 229/41 R |
| 3,135,453 | 6/1964 | Struble | 229/27 |
| 3,199,762 | 8/1965 | Coons | 229/27 |
| 3,358,960 | 12/1967 | Oliver et al. | 229/28 R X |
| 3,507,439 | 4/1970 | Helms | 229/28 R |
| 3,977,592 | 8/1976 | Gorham | 229/28 R |
| 4,126,266 | 11/1978 | Roccaforte | 229/41 B |

*Primary Examiner*—Davis T. Moorhead

[57] ABSTRACT

The partitioned container disclosed herein is prepared from a one piece blank of corrugated paperboard or the like and includes a full height divider element with an integral means for releasibly locking the divider element in place within the container.

1 Claim, 4 Drawing Figures

Fig 3.
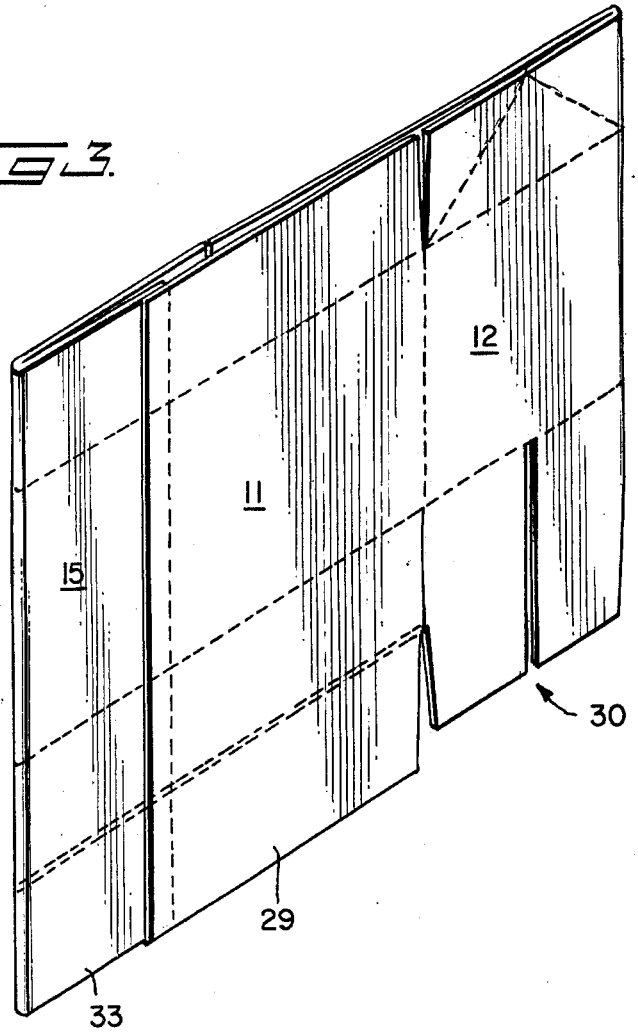
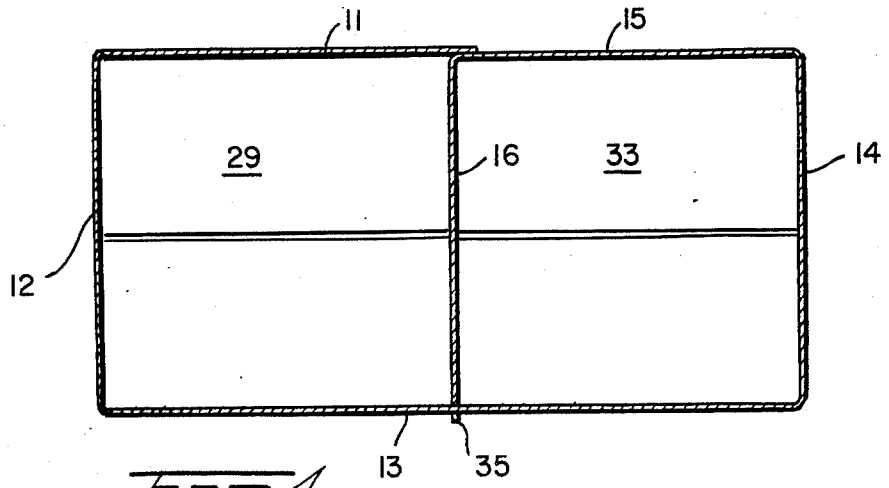
Fig 4.

PARTITIONED CONTAINER

BACKGROUND OF INVENTION

The present invention relates generally to partitioned containers, and more particularly to a collapsible, divided container that is prepared from a one piece blank of corrugated paperboard or the like, wherein the divider element is formed integrally with the blank, with a means for automatically locking the divider in place when the container is set up.

Partitioned containers are well known in the industry and find particular utility in those cases where it is desired to keep packaged products separated and where there is a need for increased stacking strength. For such purposes, it has been common place to provide the containers with divider elements that are prepared from separate divider blanks. Moreover, there is a considerable body of prior art available which shows containers with integral divider elements. However, in each instance, the prior art divided containers require more gluing steps than the divided container of the present invention, and, the prior art divided containers do not have the flexibility of design inherent in the divided container disclosed herein.

Accordingly, the present invention provides an improved construction for a divided container which is collapsible for shipment in a flattened condition, but which is readily erected for use when the integral divider element is locked into position between the opposite side walls of the container. In this regard, the divided container disclosed herein is economical in its use of material, in the space used for storage, and in the manipulative steps required for assembly.

SUMMARY OF INVENTION

The divided container of the present invention is prepared from a single blank of material such as corrugated paperboard which is folded and secured together with a single manufacturers joint. Although the manufacturers joint may be glued, stapled or sewn, the container is most advantageously manufactured on machinery with a single glue head since the divider element of the present invention does not require a separate, second gluing step. Moreover, the particular construction disclosed herein which requires only a single gluing operation, offers the box maker added versatility since any one of several different styles of bottom closures can be incorporated in the container design. With the prior art designs, wherein the integral divider element was pre-glued or adhered at each side of the container, only a R.S.B. (regular slotted bottom) could be used since the divider element interfered with the assembly of the bottom panels. However, with the present invention, any desired bottom style can be used and assembled before the divider element is folded and locked into place between the side walls.

The divided container disclosed herein is prepared from a blank of material that includes container end and side walls with one of the side walls being formed from two parts of the blank. For this purpose, the edge of one part of the two part side wall is applied with adhesive while an integral partition panel is foldably attached to the edge of the other part of the two part side wall. When the blank is glued together, the manufacturers joint becomes located substantially in the middle of one of the side walls with the partition panel freely positioned inside the container. Meanwhile, the opposed side wall includes a cut out located opposite the manufacturers joint in the first side wall and located so as to accept a locking tab on the end of the partition panel when it is desired to lock the partition panel in place. Thus, with only one gluing step and with any desired bottom style, the divided container of the present invention can be collapsed to a flattened condition for shipment and storage. Then, when needed, the container is squared in the conventional manner, the bottom is assembled and the partition panel is folded and locked in position using the slot and tab provided therefor. In this regard, while only a single slot and tab are shown herein for locking the partition panel in place, obviously multiple tab and slot elements could be provided on the blank structure as desired to accomplish the same end results.

DESCRIPTION OF DRAWING

FIG. 3 shows the container in collapsed condition; and,

FIG. 4 is a sectional view taken substantially along the lines 4—4 of FIG. 2.

DETAILED DESCRIPTION

The present invention is directed to an improvement in partitioned containers that are prepared from a single blank of corrugated paperboard or the like. The construction utilizes the concept wherein a partition panel is attached to one end of a die cut blank with the manufacturers joint located in the middle of a side wall rather than at a corner as in conventional containers. Meanwhile, the partition panel is secured in place with a tab and slot arrangement rather than being glued as shown in the prior art.

Figure 1:
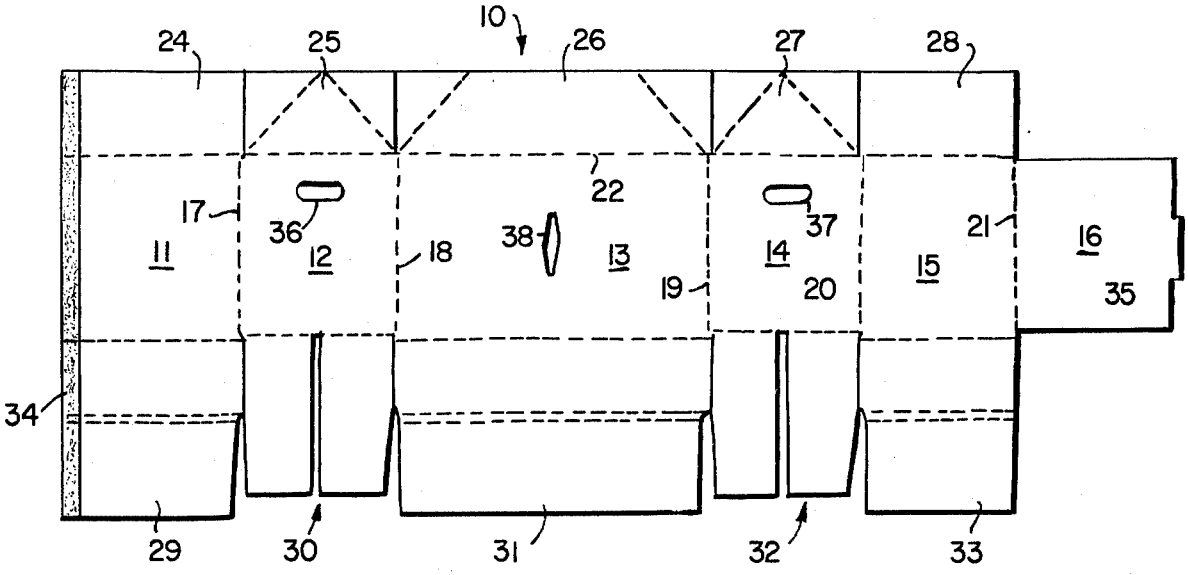
FIG. 1 is a plan view of a typical blank structure from which the divided container of the present invention might be assembled.

Referring now to the drawing, and particularly to FIG. 1, a blank 10 of corrugated paperboard is shown which comprises a one half side panel 11, a first end panel 12, a full side panel 13, a second end panel 14, a second one half side panel 15 and a partition panel 16, all foldably connected in series by the score lines 17,18,19,20 and 21. Meanwhile, the primary container side and end walls 11,12,13,14 and 15 each have attached to the ends thereof top closure flaps 24,25,26,27 and 28, and bottom closure flaps 29,30,31,32 and 33. The top closure flaps illustrated are of a conventional type and include selected diagonal scores which permit an easy assembly of the top after the container is loaded. The bottom closure flaps illustrated are of a type that is referred to in the industry as a "Form-A-Cell" bottom. Generally, the bottom flaps illustrated are used to provide interior cells within a container. However, in the present case, the bottom flaps are folded over to provide a triple thick bottom. The latter bottom is obtained when the double scored flaps 29–30 and 31 are folded around the split flaps 30,32 to encase respective pairs of the split flaps in a sandwich relation. It should be noted however that the bottom construction illustrated is only exemplary to show the versatility of the present invention since any desired bottom configuration can be used with the improved partition panel arrangement described more fully hereinafter.

As will be apparent from the drawings herein, particularly FIGS. 1 and 3, the terminal edge of the half side panel 11 is crushed or compressed to compact the corrugated material in that region and adhesive 34 is applied thereto as shown. Subsequently, the partition panel 16 is folded over to adhere the edge of the first half side panel 11 to the edge of the second half side panel 15. FIG. 3 shows the glued blank in its flattened condition as shipped to the user. At the point of use, the bottom flaps 29,30,31,32 and 33 are assembled as set forth hereinbefore and the partition panel 16 is folded and locked into position. For this purpose, the partition panel 16 is seen to include at least one tab element 35 along the outer edge thereof, which is folded and locked into the slot 38 provided in the opposed side wall 13. Thus, because the panel 16 can be folded out of the way during the assembly of the container bottom, the bottom flaps may take any desired configuration. Moreover, when the panel 16 is folded and locked into its container dividing position, the panel tends to keep the bottom flaps in their folded condition.

Figure 2:
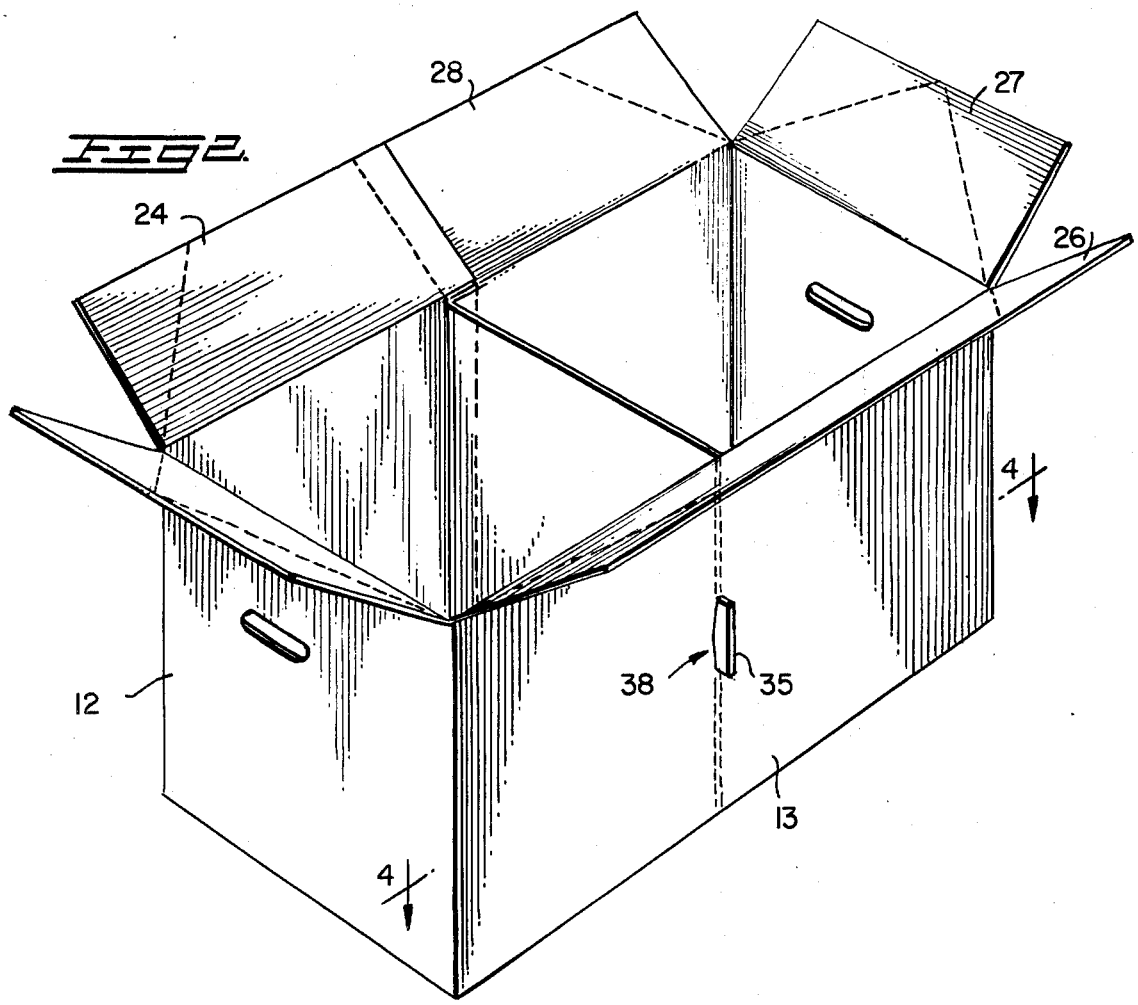
FIG. 2 is a perspective view of an assembled container prepared from the blank of FIG. 1.

FIG. 2 illustrates the fully set up container with the tab element 35 engaged in the slot 38 provided therefor. In the embodiment shown, the partition panel 16 is illustrated as being a full height divider element. A full height panel 16 is preferred in order to achieve the increased stacking strength inherent in such a construction. Meanwhile, reference to the cross sectional view of FIG. 4 shows how the divider panel 16 serves as a means for holding the bottom closure flaps 29,33 and 31 in place. After the container is filled, the top closure flaps 24,25,26,27 and 28 are alternately folded closed and secured beneath one another. Obviously, after its initial use, the divided container disclosed can be reused simply by unlocking the partition panel, disassembling the bottom and folding the blank once again to its flattened condition.

Accordingly, there is disclosed herein a preferred embodiment for the present invention. However, it is anticipated that changes may be made to the embodiment shown without departing from the spirit and scope of the invention as defined in the appended claims.

I claim:

1. A collapsible, partitioned container prepared from a single blank of corrugated paperboard or the like comprising a first half side panel, a first end panel, a full side panel, a second end panel, a second half side panel and a partition panel connected in series, said series of hinged panels defining the primary walls and an integral partition panel for said container, top and bottom closure flaps foldably attached to the ends of said primary walls, and means for adhering the terminal edge of the first half side panel to the edge of said second half side panel adjacent to said partition panel, the improvement comprising means for releasibly locking said partition panel between the side walls formed by the first and second half side panels and the full side panel of said container, said means comprising cooperating elements located on the end of said partition panel and in said full side wall panel for retaining said partition panel in position said means consisting of at least one locking tab element integral with said partition panel and extending beyond the end of said partition panel and at least one locking slot located in said full side panel.

* * * * *